US007299853B2

(12) United States Patent
Brown et al.

(10) Patent No.: US 7,299,853 B2
(45) Date of Patent: Nov. 27, 2007

(54) HIGH WIND LOAD RESISTANT SECTIONAL WOOD OVERHEAD DOOR, ASSEMBLY, AND METHODS

(75) Inventors: Mike Brown, River Falls, WI (US); Kent Forsland, River Falls, WI (US); Tom Garfin, River Falls, WI (US)

(73) Assignee: Designer Doors, Inc., River Falls, WI (US)

( * ) Notice: Subject to any disclaimer, the term of this patent is extended or adjusted under 35 U.S.C. 154(b) by 725 days.

(21) Appl. No.: 10/684,200

(22) Filed: Oct. 10, 2003

(65) Prior Publication Data

US 2004/0163776 A1 Aug. 26, 2004

Related U.S. Application Data

(60) Provisional application No. 60/417,844, filed on Oct. 11, 2002.

(51) Int. Cl.
*E05D 15/16* (2006.01)

(52) U.S. Cl. ..... 160/201; 160/232

(58) Field of Classification Search ..... 160/201, 160/229.1, 232, 209, 213, 235, 236
See application file for complete search history.

(56) References Cited

U.S. PATENT DOCUMENTS 2,931,435 A * 4/1960 Neisewander ..... 160/229.1
3,178,776 A * 4/1965 Stansberry ..... 52/456
3,402,457 A * 9/1968 Landow et al. ..... 29/428
3,927,709 A * 12/1975 Anderson et al. ..... 160/37
4,828,004 A * 5/1989 Martinez ..... 160/229.1
5,819,834 A 10/1998 Wedekind
5,964,269 A 10/1999 Decola
6,062,293 A * 5/2000 Berger, Jr. ..... 160/229.1
6,082,431 A 7/2000 Decola
6,112,799 A * 9/2000 Mullet et al. ..... 160/201
6,330,901 B1 12/2001 Friesen et al.
6,341,639 B1 1/2002 Mullet et al.
6,446,695 B1 9/2002 Forsland
6,463,988 B1 10/2002 Mullet et al.

* cited by examiner

*Primary Examiner*—David Purol
(74) *Attorney, Agent, or Firm*—Merchant & Gould P.C.

(57) ABSTRACT

A sectional wood overhead garage doors to withstand very high wind loads such as those created by hurricane force winds typically greater than 90 mph and which can be greater than 140 mph. The door meets design pressures of −65 psf and +48 psf. The door includes panel sections hingedly connected, each panel section having a frame assembly composed of upper and lower rails and, at least, a pair of end stiles, which form a substantially rectangular border. The frame assembly is fixedly attached to front and back surface protection members, which increase the resistance to wind-induced forces and the impact of objects. The front surface protection member may include a decorative protection assembly that provides an aesthetically pleasing, decorative surface. The decorative protection assembly can be constructed to resemble a flat panel door, a raised panel door, a turn-of-the-century carriage door, and the like.

21 Claims, 6 Drawing Sheets

HIGH WIND LOAD RESISTANT SECTIONAL WOOD OVERHEAD DOOR, ASSEMBLY, AND METHODS

Priority under 35 U.S.C. § 119(e) is claimed to provisional application Ser. No. 60/417,844, filed on Oct. 11, 2002, and entitled "High Wind Load Resistant Sectional Wood Overhead Door". The complete disclosure of application Ser. No. 60/417,844 is incorporated herein by reference.

FIELD

The present invention generally relates to sectional wood overhead doors used to create access to building interiors in residential and commercial applications. More specifically, the present invention relates to sectional wood overhead doors designed to withstand very high wind loads such as those created by hurricane force winds typically greater than 90 mph and often greater than 140 mph.

BACKGROUND

Weather is a major cause of extreme damage and human injury. Hurricanes and tropical storms, prolific on the east coast and gulf coast of the United States, particularly in Florida, are examples of weather occurrences that wreck havoc with buildings. Many building codes, particularly in hurricane-prone areas, require that doors and windows in habitable structures meet strict structural design parameters. The structural integrity of doors, windows and exterior cladding elements is strictly governed by these codes.

It is now understood that the garage door, in residential applications, is a large factor in the amount of structural damage experienced by the entire structure. When a garage door fails under wind load, the effects are usually devastating to the entire building. A garage door has a relatively large exposed area (typically at least 72 sq. ft) in proportion to the enclosure. When the door fails under high wind load, the resultant sudden pressurization of the enclosure often results in complete destruction of the building.

New code requirements, especially in south Florida, have generated a rapidly growing industry in hurricane-resistant building envelopes and components.

There are several main performance criteria directed to doors and windows, for example "impact resistance," "structural load capacity," "cyclic resistance," and "uniform static air pressure resistance". Impact resistant performance criteria recognize the need for resistance to windborne debris, which can cause catastrophic damage when striking a door or window under structural load.

One alternative to installing either impact resistant or high wind resistant components into building openings has been to "shutter" the opening with structurally designed and approved devices that are physically placed over the opening prior to the high wind event. These shutter systems increase the door's resistance to impact from objects and to high pressures. However, because of the physical size of the garage door, the shutter system is cumbersome and expensive, and renders the garage unusable while "shuttered."

Because of the aforementioned issues concerning the shuttering of garage door openings, a strong demand was present to provide a garage door with high impact resistance and high wind load performance inherent in its design. Further, the insurance industry and building code enforcement entities are particularly interested in garage door products that do not require shuttering. The state of Florida has passed building code protocols TAS 201, 202 and 203, and Miami-Dade county has testing protocols PA-201, PA-202 and PA-203, which set the standard wind load resistance of −65 psf and +48 psf for large missile impact garage doors.

Currently, there are no products that meet the construction standards yet provide an aesthetic, customized wood door. The typical designs used in sectional garage doors to offer high wind load performance are based on a standard metal door incorporating any number in integral reinforcing devices in the door assembly or as external attachments. These metal doors generally do not offer load rated windows. The flexibility of design is extremely limited in the current products. Improvements are desired.

SUMMARY

The present invention provides a custom designed garage door and garage door assembly that can incorporate aesthetic features while meeting strict standards and without hampering functionality. The present invention provides a "platform" design for a garage door that withstands structural loads while offering a high degree of flexibility in the facade of the door. The design allows for windows or "lites" in a door to provide architectural design elements and natural light in the interior space. The door of this invention also resists rot, decay and invasion by wood boring insects, which is beneficial in areas such as Florida that have high humidity climates that are conducive to these conditions.

In particular, the present invention generally relates to sectional wood overhead doors used to create access to building interiors in residential and commercial applications. The present invention provides a sectional wood overhead door designed to withstand very high wind loads such as those created by hurricane force winds typically greater than 90 mph and which can be greater than 140 mph. Additionally or alternatively, the present invention provides a sectional wood overhead door and assembly designed to meet or exceed design pressures of −65 psf and +48 psf, in accordance with Miami-Dade County testing protocols PA-201, PA-202 and PA-203 and Florida state building code protocols TAS 201, 202 and 203.

This invention incorporates specific construction designs and techniques to create and install a high wind load wood overhead sectional door: The invention provides a sectional wood overhead door that remains operative after excessively high wind load exposure.

In particular, a wind-resistant wood door able to withstand 140 mile per hour wind forces is disclosed. The door includes a plurality of panel sections hingedly connected, thus allowing the door to be moveably positioned between open and closed positions. Each panel section includes a frame assembly composed of upper and lower rails and, at least, a pair of end stiles. The rails and stiles form a substantially rectangular border surrounding an interior section. The frame assembly is fixedly attached to front and back surface protection members, which increase the ability of the panel sections to resist wind-induced forces and the impact of objects. The front surface protection member may include a decorative protection assembly that provides an aesthetically pleasing, decorative surface. The decorative protection assembly can be constructed to resemble a flat panel door, a raised panel door, a turn-of-the-century carriage door, and the like.

The wood door also includes a plurality of force transmittal arrangements on the interior of the door coupled to the interior of the building structure in which the door is installed. The force transmittal members transfer the wind-induced forces from the panel sections to a frame attached to the building structure and surrounding the door. Preferably, each force transmittal arrangement includes a hinge member and a roller member. The force transmittal arrangement transfers the force to the building structure through a tapered jamb mount and gusseted mounting brackets.

The wood door may include a panel section having at least one window therein. Such a panel section includes a frame assembly having upper and lower rails and at least a pair of end stiles. The rails and stiles form a substantially rectangular border surrounding an interior section that includes a window section. The window section includes a glass setting lip member preferably integral with the rails and stiles surrounding the window. The window section also includes a stop member that is coupled to the frame opposite the glass setting lip for holding the window glass in place. Each of the glass setting lip and the stop includes a pocket that allows an adhesive material to be placed between the pockets and the glass to retain the window in the panel section. Optionally, an impact rated window can be secured within the window section.

Another aspect of the present disclosure is directed to a method of assembling a sectional wood door to withstand 140 mile per hour wind-induced forces. The method includes creating frames for a plurality of panel sections. The frames are coupled to interior and exterior wooden protective panels to form a boxed structure. The method may include making a window panel section for the door. This method includes holding a window in place with between protruding glass setting lip sections and one or more stops located opposite the glass setting lips.

A more complete appreciation of the present invention and its scope may be obtained from the accompanying drawings that are briefly described below, from the following detailed descriptions of presently preferred embodiments of the invention and from the appended claims.

BRIEF DESCRIPTION OF THE DRAWING

The invention may be more completely understood in consideration of the following detailed description of various embodiments of the invention in connection with the accompanying drawing, in which:

FIG. 5A illustrates a first embodiment of a jamb mounting assembly into wood framing; FIG. 5B illustrates a second embodiment of a jamb mounting assembly into filled block or solid concrete; FIG. 5C illustrates a third embodiment of a jamb mounting assembly shimmed to wood framing; and FIG. 5D illustrates a fourth embodiment of a jamb mounting assembly shimmed to filled block or solid concrete;

Figure 1:
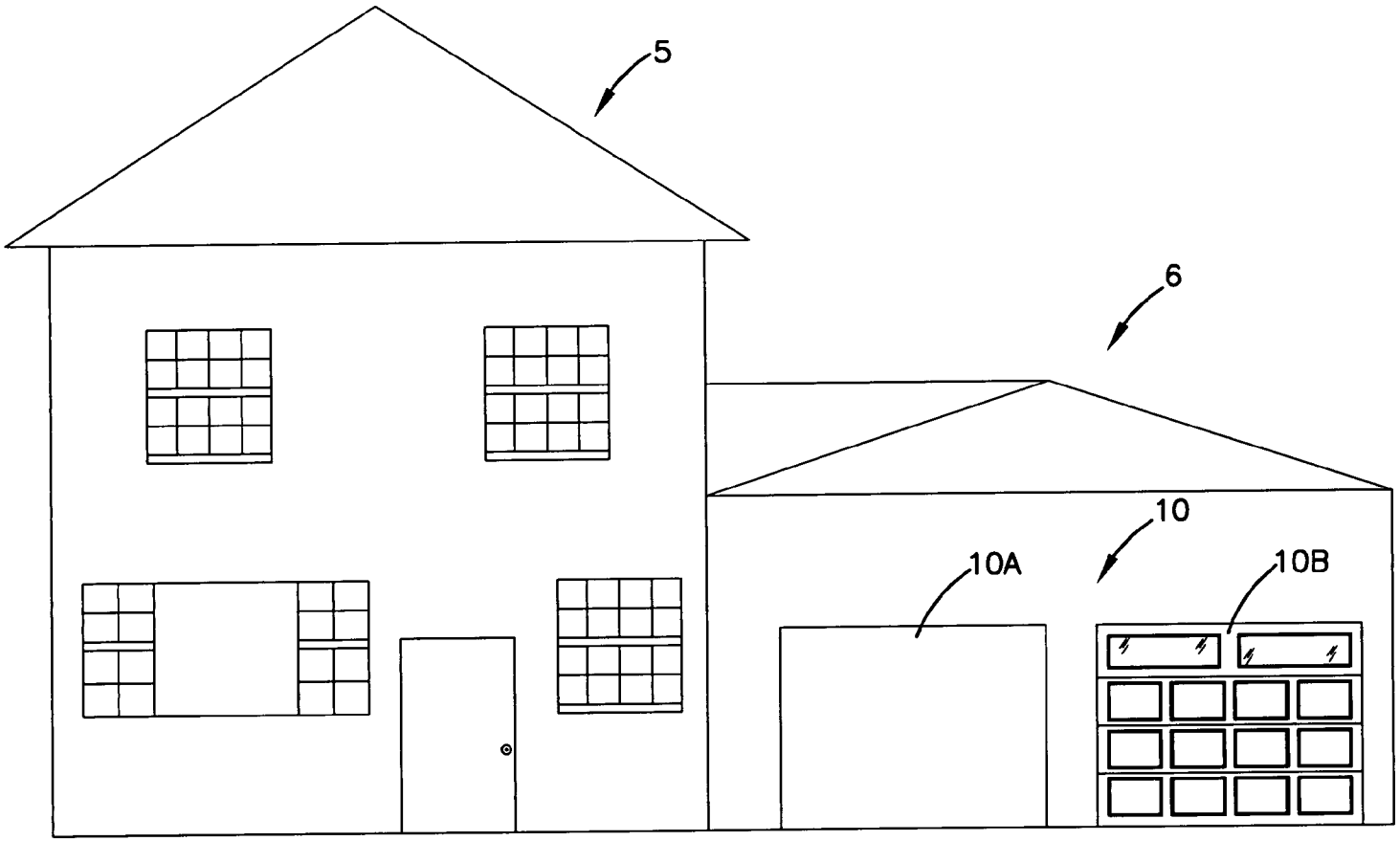
FIG. 1 is a schematic, front plan view of a garage having two garage doors installed thereon.

While the invention is amenable to various modifications and alternative forms, specifics thereof have been shown by way of example in the drawing and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

In the following description of preferred embodiments of the present invention, reference is made to the accompanying drawing that forms a part hereof, and in which is shown by way of illustration specific embodiments in which the invention may be practiced. It is understood that other embodiments may be utilized and structural changes may be made without departing from the scope of the present invention.

Referring to FIG. 1, a typical, residential house 5 is shown having a garage 6 with side-by-side single garage doors 10, specifically, doors 10A and 10B. Although garage 6 is illustrated as attached to house 5, garage 6 with doors 10A, 10B could be a detached garage. Also, although garage 6 is illustrated with two doors 10, garage 6 could have one door 10, three doors 10, or more.

Figure 2A:
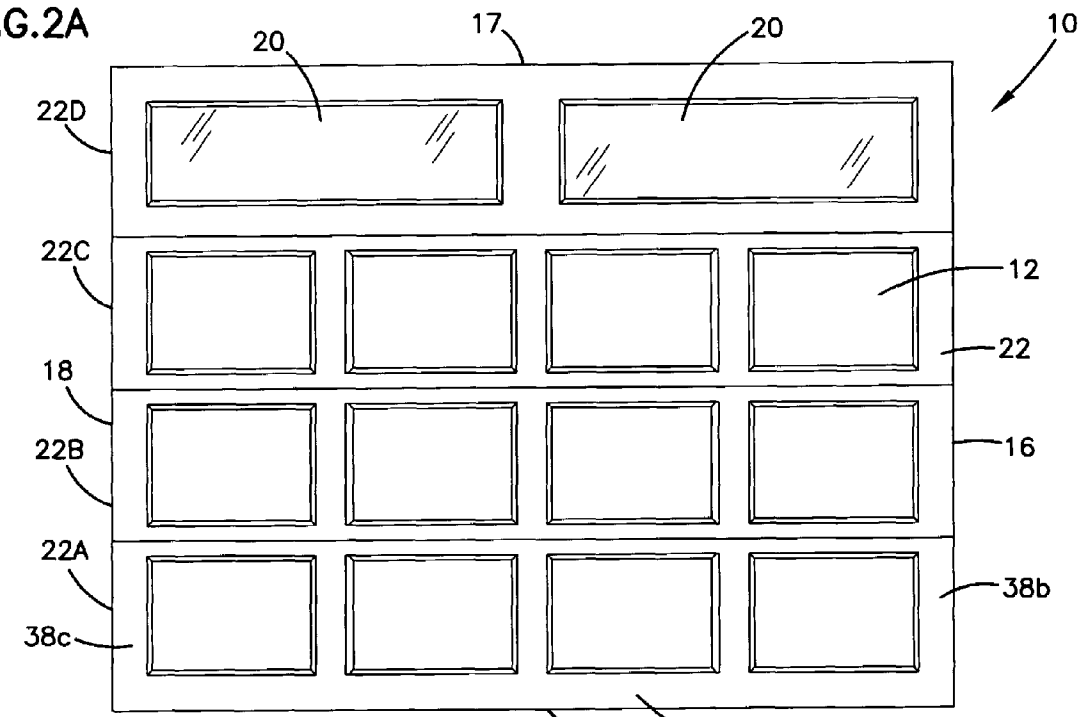
FIG. 2A is a plan view of the front, exterior side of a garage door according to the present invention, similar to one illustrated in FIG. 1.

Referring to FIG. 2A, garage door 10 is illustrated as seen from the exterior of garage 6. That is, in FIG. 2A, the exterior side or surface 12 of door 10 is seen. Door 10 has a first side edge 16, and opposite side edge 18, a top edge 17 and a bottom edge 19.

Typical sizes for door 10, if a single garage door, include 8 ft wide by 7 ft high (96 inches×84 inches), 8 ft by 8 ft (96 inches×96 inches), and 9 ft by 8 ft (108 in inches). Door 10 as wide as 10½ feet (126 inches) is also possible. Double garage doors are also within the scope of this invention.

Door 10 has an ornamental facade on exterior surface 12. In this illustrated embodiment, the facade includes twelve raised panels and two windows. Other facades for door 10 are known and are suitable for use with door 10 of the present invention. For example, other suitable facades include flat panels, three or four windows, and v-groove panels. See also, for example, U.S. Pat. Nos. Des. 378,853, Des. 378,421, Des. 380,053, Des. 382.065, Des. 382,066, Des. 382,067, Des. 383,551, Des. 397,446, Des. 397,447, and 6,446,695, all which are incorporated herein by reference and which disclose various facade configurations that are suitable for door 10. One popular facade is that of an old fashioned-looking carriage door.

Door 10 is an overhead door, intended to be supported by and move on side-mounted tracks or rails, as will be described below. Door 10 is composed of multiple panel sections 22; particularly, door 10 has bottom section 22A, second section 22B, third section 22C, and fourth or top section 22D. Top section 22D includes windows 20 and is a windowed panel 22D.

Door 10 is a "wood" door, meaning, that the structure of door 10 is composed of wood. There is no appreciable amount of metal in any of the components that make up panels 22; these wood components, along with any metal hardware, are described below.

Figure 2D:
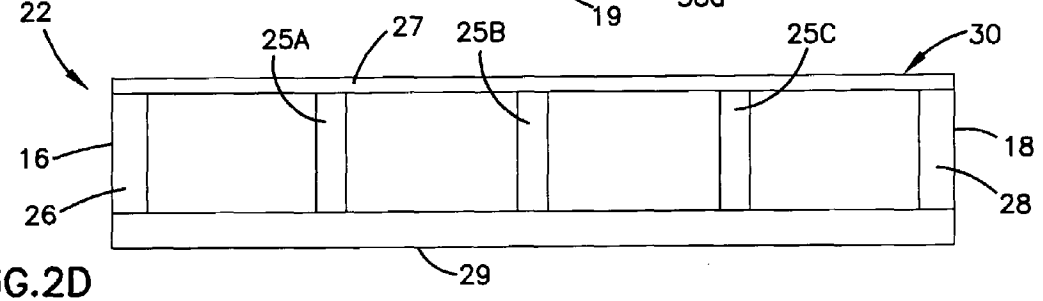
FIG. 2D is a plan view of the internal structure of a panel section of the garage door of FIG. 2A.
Figure 2C:
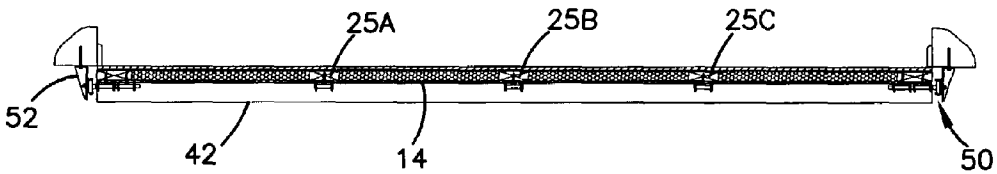
FIG. 2C is a cross-sectional view of the garage door, taken along line C-C of FIG. 2B.
Figure 2B:
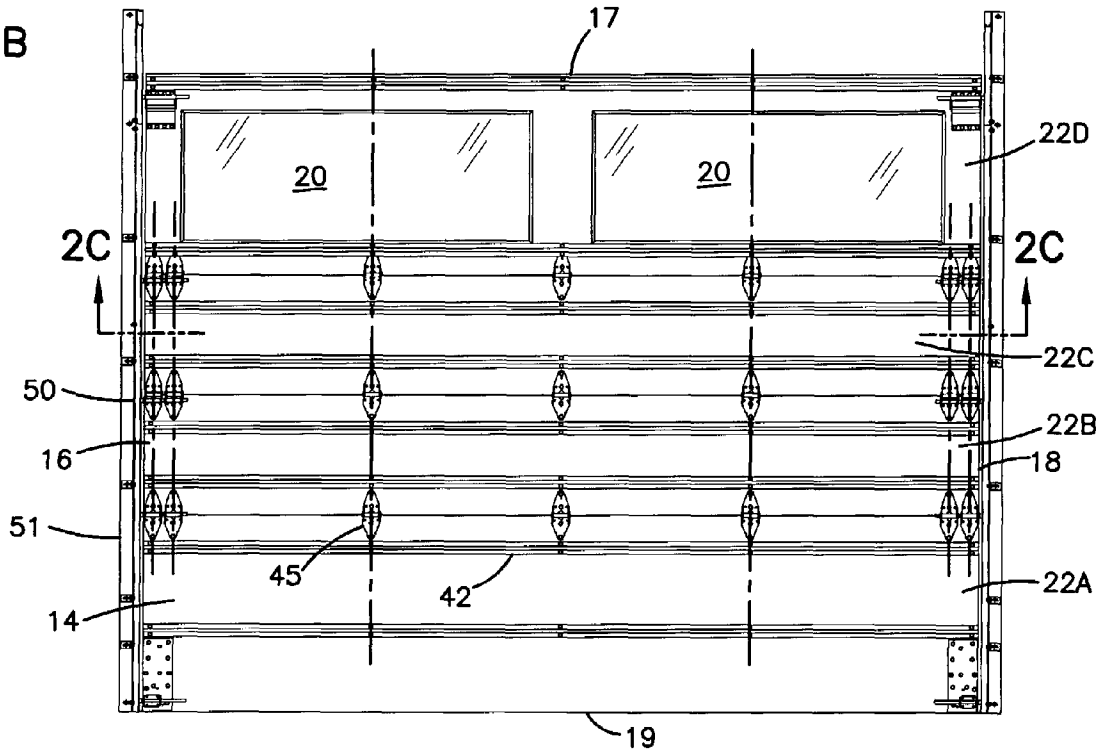
FIG. 2B is a plan view of the back, interior side of the garage door of FIG. 2A.

A view of the backside, or the interior side, of door 10 is illustrated in FIG. 2B. From this side, interior surface 14, first side edge 16, second side edge 18, top edge 17, and bottom edge 19 can be readily seen, as can panel sections 22A, 22B, 22C, 22D. Panel sections 22A, 22B, 22C, 22D are movably held together by hinges 45.

Each of panel sections 22A, 22B, 22C, 22D typically has a vertical height within the range of about 14 inches to about 36 inches. In some embodiments, the vertical height is about 18 inches to 30 inches per section. In some designs, not all sections 22A, 22B, 22C, 22D will have the same height. In use, because the wind load is concentrated in the center of door 10, it is desirable to make the center or middle panels 22B, 22C smaller than the bottom panel 22A and top panel 22D. It is understood that the overall height of door 10 will greatly impact the height of individual panels 22. For example, in one design of door 10, panel 22A may have a height of 25⅜ inches, panels 22B, 22C may have a height of 18 inches, and panel 22D may have a height of 25⅜ inches. In a second design of door 10, panel 22A may have a height of 29½ inches, panels 22B, 22C may have a height of 22⅜ inches, and panel 22D may have a height of 30 inches. Alternately, a door with the same height as the second design, yet with five panels, two panels of 25⅜ inches and three panels of 18 inches, could be made. Generally, the variation in panel height can be adjusted as desired for the desired door height. In certain constructions for door 10, however, it is desired that no two adjacent panels together are more than 52⅜ inches. Such a maximum height is dependent on variations such as door width, overall panel construction, the presence of windows 20, and the like.

In FIG. 2B, door 10 is illustrated as being installed within an opening in a building structure. In particular, door 10 is mounted on mounting track 50 at each of first side edge 16 and second side edge 18.

The internal construction of door 10 can be understood by reference to FIGS. 2C and 2D. In FIG. 2D, the top most-layer of one panel 22 from door 10, when viewed from interior side 14, has been removed, exposing the interior construction of panel 22.

Door 10 is constructed using a boxed frame assembly, which is a substantially rectangular border surrounding an interior section, and which uses a stile and rail construction technique. Within the frame assembly, rails extend horizontally and stiles extend vertically. Referring to FIG. 2D, frame assembly 30 includes top rail 27 and bottom rail 29. Extending therebetween are a plurality of stiles, specifically, first side stile 26 (at first side edge 16), second side stile 28 (at second side edge 18), and internal stiles 25A, 25B, 25C. Panel 22, as shown in FIG. 2D, includes four frame assemblies 30: the first formed by top rail 27, bottom rail 29, first side stile 26 and internal stile 25A; the second formed by top rail 27, bottom rail 29, internal stile 25A and internal stile 25B; the third formed by top rail 27, bottom rail 29, internal stile 25B and internal stile 25C; and the fourth formed by top rail 27, bottom rail 29, internal stile 25C and second side stile 28. The maximum distance allowed between the centerlines of internal stiles 25A, 25B, 25C is 28⅝ inches. The maximum distance allowed between the centerline of internal stiles 25A, 25C and the outer edge of side stiles 26, 28, respectively, is 34⅜ inches.

Frame assembly 30, and each of rails 27, 29 and stiles 26, 28, 25A, 25B, 25C are made from wood. Although screws, bolts, nails and other metal fasteners may be used to hold together frame 30, frame 30 is considered a wood structure. With a wood structure, a cope and stick technique is preferably used to join frame 30 together.

Generally any wood material is suitable for rails 27, 29 and stiles 26, 28, 25A, 25B, 25C, although a preferred material is Douglas Fir or other wood having an equal or greater strength and density. A suitable size for the rails and stiles is common 2×4 or 2×6 dimensioned lumber, although other sizes can be used.

Frame assembly 30 is preferably constructed using a pocket hole attachment system, which is a well-known attachment construction known in the wood construction arts. A bore is provided angled through the first piece of wood (e.g., stile 25) into the second piece of wood (e.g., bottom rail 29). The bore is sized and shaped so that the head of a fastener, such as a lag bolt, is seated within the first piece, and the fastener extends into the second piece. Preferred fasteners for this application include 2 inch hardened steel screws. An adhesive may be included in the joint between rails 27, 29 and the stiles; preferably, this is a waterproof adhesive, or at least a water resistant adhesive. An example of a suitable adhesive is that available under the trade designation "Gorilla Glue" from Lutz File & Tool Co.

Figure 3:
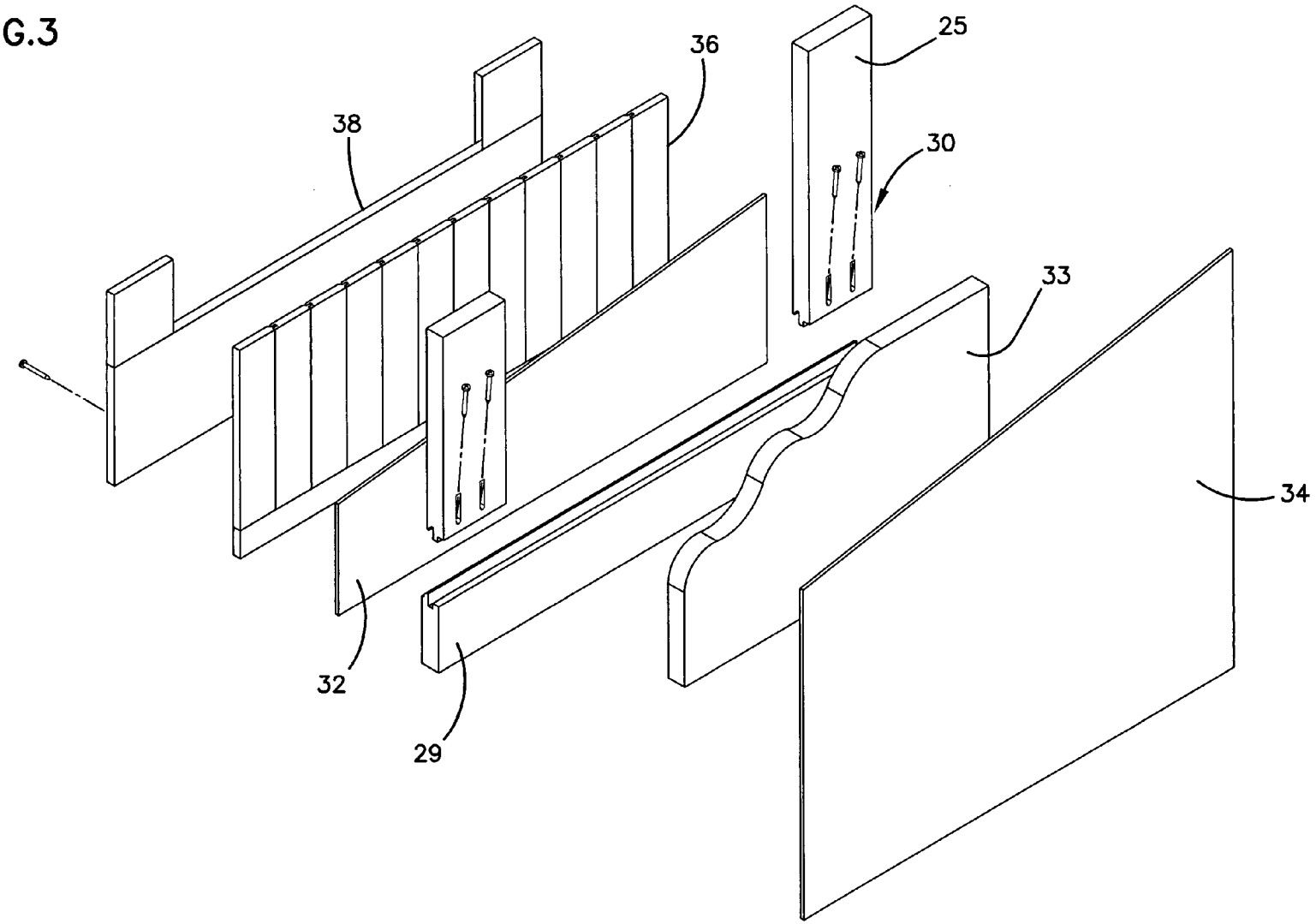
FIG. 3 is an exploded view of a cut away portion of a garage door according to the present invention.

Frame assembly 30 forms the structural base for panel 22. As seen in FIG. 3, which is an exploded view of a panel, frame assembly 30 is sandwiched by various layers. (In this figure, bottom rail 29 and two stiles 25 of frame 30 are shown.) In particular, a first, exterior surface protection layer 32 is fixedly attached to frame 30 and a second, interior surface protection layer 34 is fixedly attached to frame 30; together, frame 30 and surface protection layers 32, 34 form a boxed structure.

Examples of suitable wood layers for surface protection layers 32, 34 include plywood, OSB, chip board, and the like. Suitable thickness for surface protection layers 32, 34 include 3/16 inch, ¼ inch, ⅜ inch, ½ inch, and ⅝ inch. In one particular construction, protection layers 32, 34 are each ¼ inch thick plywood. In one preferred embodiment, together, exterior and interior surface protection layers 32, 34 are about ½ inch thick. This will vary, however, depending on the type of wood material being used.

To this point, a basic "platform" design has been provided for door 10. Frame assembly 30, composed of rails 27, 29 and stiles 26, 28, 25, forms a substantially rectangular border surrounding an interior section. To frame assembly 30 is fixedly attached to exterior and interior surface protection layers 32, 34, which together provide a boxed panel section 22 to resist wind-induced forces and the impact of objects. Exterior surface protection layer 32 may include a decorative layer that provides an aesthetically pleasing, decorative surface.

Referring again to FIG. 3, a decorative layer is present over exterior surface protection layer 32. This decorative layer may also provide some amount of impact resistance to door 10. In the embodiment illustrated in FIG. 3, this decorative layer includes a layer of v-groove boards 36, which completely covers exterior surface protection layer 32. Additionally, FIG. 3 illustrates decorative trim boards 38. Returning to FIG. 2A, door 10, therein, is illustrated with multiple decorative trim boards, for example, trim board 38*a* extending along the bottom edge 19, trim board 38*b* extending along side edge 16, trim board 38*c* extending along side edge 18, and other trim boards. In one example facade, trim boards 38*a*, 38*b*, 38*c* and the trim board at top edge 17 are about 5¼ inches in width, and the other trim boards are about 4½ inches in width.

Examples of suitable woods for decorative layers 36, 38 include No. 3 Western Cedar, Oak, Cherry, Mahogany, Poplar, Yellow Pine, Redwood, spruce, Fir, Maple, Douglas Fir, Birch, Teak, Hickory, Cyprus, and No. 2 Aspen, Western Pine, Eastern Pine and Ponderosa Pine, and other such wood materials. Typically, these decorative layers are plywood or other sheet stock, although individual boards could be used. The plywood or other sheets could have a pattern, such as grooves, present thereon. If individual boards are used, these could be interconnected by a tongue and groove system. Any pattern can run horizontal, vertical, or at an angle. Suitable thicknesses for decorative layers 36, 38 include any thickness from ⅛ inch to 1 inch. In one particular construction, decorative layer 36 is ¾ inch thick red cedar plywood and decorative trim boards 38 are each ¾ inch thick cedar face boards. In another particular construction decorative layer 36 is 9/16 inch thick v-groove facing. In one preferred embodiment, together, exterior and interior surface protection layers 32, 34 and decorative layer 36 are about 2 inches thick. This will vary, however, depending on the type of wood material being used.

The decorative layers, such as decorative plywood 36 and decorative trim boards 38 can be attached to exterior surface protection layer 32 by any suitable fastening system, including mechanical fasteners (e.g., nails, screws, staples, etc.), chemical attachment (e.g., adhesives), or any combination. One preferred combination is 2 inch stainless steel screws and urethane adhesive commercially available under the trade designation "Chemrex 948".

As stated above, frame 30 defines an interior area surrounded by rails 27, 29 and the appropriate stiles. As illustrated in FIG. 3, an insulation material 33 may be positioned in this interior area. As example of a suitable insulation material 33 is 1 3/16 inch thick polystyrene insulation, either expanded or extruded.

Figure 4:
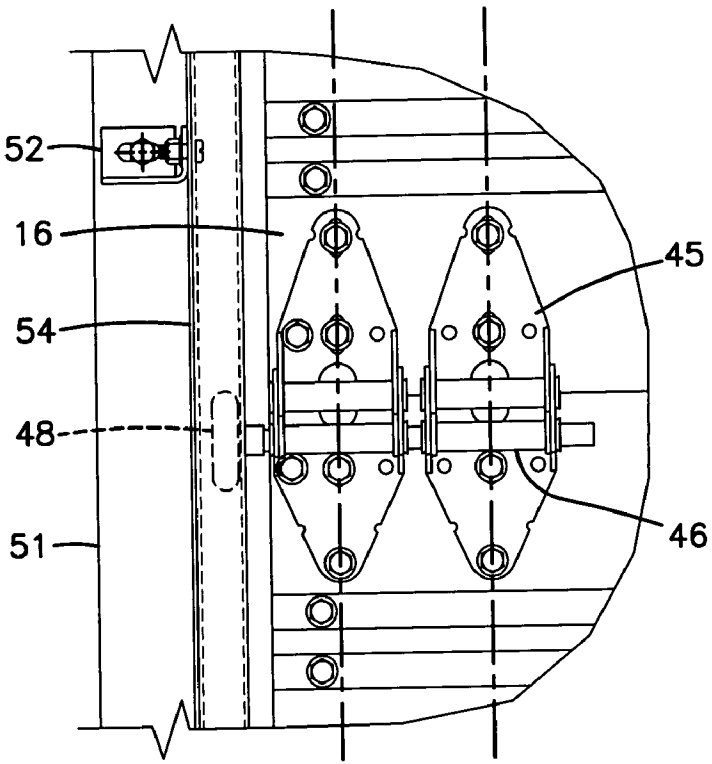
FIG. 4 is an enlarged plan view of a side hinge region, located on the interior side of the garage door of FIG. 2B.

Multiple sections 22 are connected together via hinges 45, as illustrated in FIG. 2B. Hinges 45 allow door 10 to be moveably positioned between open and closed positions, as is typical for overhead garage doors. Reference is now made to FIG. 4, where one connection between two panel sections, sections 22B and 22C, is illustrated.

Panel sections 22B and 22C are illustrated connected by two hinges 45, positioned at an outer edge of door 10, in particular, at first side edge 16. Two similar hinges 45 are positioned at opposite side edge 18. Hinges 45 includes a passage 36 for accepting a portion of a roller member 48 therein, specifically, the shaft of roller member 48. Roller member 48 moveably seats within track 50 and guides door 10 as it moves between the open and closed positions.

The set of double hinges 45, at a side edge of door 10, are secured to door through interior surface protection layer 34 to end stile 26 by fasteners. In one embodiment, the distance between the edge of stile 26 and the centerline of the inner-more hinge 45 is 4 ½ inches. In a preferred embodiment, each hinge 45 is 11 gauge material held by at least four fasteners such as screws or lag bolts. In one embodiment, the distance between the centerline of double hinges 45 is 3 1/16 inches. In the embodiment illustrated in FIG. 4, the outermost hinge 45 has six screws or lag bolts holding hinge 45 to door 10.

Hinges 45, together with roller members 48, form a force transmitting arrangement. Roller members 48, movably retained in track 50, which in turn is fixedly attached to the building structure, transfer the forces that may occur on door 10 to the building structure.

Roller member 48 has a wheel mounted on a central shaft. This wheel may be made from, or have a surface coating of, steel, nylon, rubber, or other suitable material. The wheel is rotatable in relation to the shaft. In some embodiments, roller member 48 is not rotatably movable in relation to track 50; rather, an element designed to slide within or in relation to track 50 may be used.

Roller member 48, in particular its shaft, play an integral part in providing a garage door assembly that is capable of withstanding the high wind load demands (e.g., +48 psf to −65 psf). The shaft is preferably made from a high strength, high tensile steel, such as hardened steel. One preferred material for the shaft is 1045 cold rolled steel.

In one preferred embodiment, roller member 48 has an overall length of 7.719 inches, with the shaft being 6.688 inches and 0.438 inches in diameter. The wheel has a diameter of 1.76 inches and a thickness of 0.531 inch.

Track 50 includes various portions that provide a solid structure for transferring forces from door 10 to the building. An elongate channel 54 is included for receiving roller member 48. A tapered jamb mount 51, fixedly attached to the building structure, solidifies channel 54 against a large wind against exterior surface 12 of door 10. Also included are gusseted mounting brackets 52, which reinforce jamb mount 51. Track 50, including all the components, together with roller member 48, are sufficiently strong to support and hold door 10 in place against the force against surface 12.

Attached to the building structure, along the height of door 10, is tapered jamb mount 51. This 90-degree metal brace, in one embodiment 0.083 inch thick, provides a continuous brace for attachment of elongate channel 54 to the building structure. Jamb mount 51 is tapered, in that it is wider at the top of door 10 than at the bottom; this is because as door 10 opens (e.g., rolls up track 50), the distance between elongate channel 54 and the building structure increases.

Figure 6:
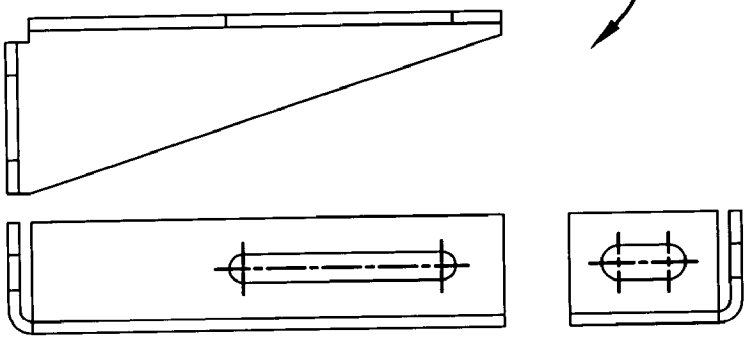
FIG. 6 illustrates a bracket of the mounting assembly suitable for the garage door according to the present invention, in top plan, side plan, and front plan views.

Mounting bracket 52 reinforces tapered jamb mount 51 and includes a gusset to increase the resistance to flex. A preferred construction for gusseted mounting bracket 52 is illustrated in FIGS. 2B, 4 and 5A through 5D and detailed in FIG. 6. In this preferred embodiment, the overall length of bracket 52 is 4.25 inches; in an alternate preferred embodiment, the overall length of bracket 52 is 5.0 inches. The width of a preferred gusseted mounting bracket 52 is 1.75 inches, the height is 1.12 inches, and the thickness of the metal stock of bracket 52 is 0.12 inch.

Figure 7:
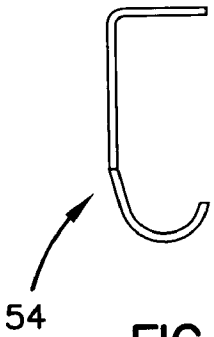
FIG. 7 is a cross-sectional view of a track suitable for the garage door according to the present invention.

A preferred construction for elongate channel 54 is illustrated in FIG. 7. In this preferred embodiment, the overall length of channel 54 is 2.11 inches, with the straight portion being 1.4 inches. The curved portion of channel 54 is defined by a 0.45 inch radius. The width of channel 54, defined by the portion of channel 54 perpendicular to the long side, is 1.0 inch. The thickness of the metal stock of channel 54 is 0.079 inch (11 gauge) and the opening for accepting roller member 48 is 1.66 inches.

Although dimensions for a preferred construction for channel 54 have been provided, it is understood that generally any channel, capable of movably accepting roller member 48 therein, would be adequate.

Figure 5A:
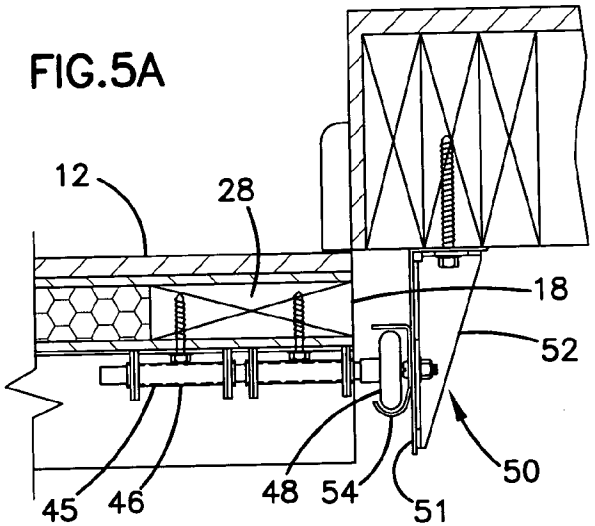
FIGS. 5A through 5D are cutaway views of installation details for a garage door according to the present invention.

Various constructions for mounting the assembly which includes door 10 and track 50, to the building structure are illustrated in FIGS. 5A through 5D. In FIG. 5A, the door is illustrated attached to a wooden jamb with a 5/16 inch diameter lag bolt. This lag bolt passes through bracket 52 and jamb mount 51 and should penetrate the wood jamb a minimum of 2½ inches. Front surface 12 of door 10 is generally flush with the interior surface of the wooden jamb in which track 50 (which includes gusseted bracket 52 and elongated channel 54) is mounted, and side edge 18 of door 10 does not overlap the jamb. Hinge 45, with roller passage 46, is screwed into side stile 28. Roller member 48 has its shaft extending into passage 46 and has its roller head retained within channel 54.

Figure 5B:
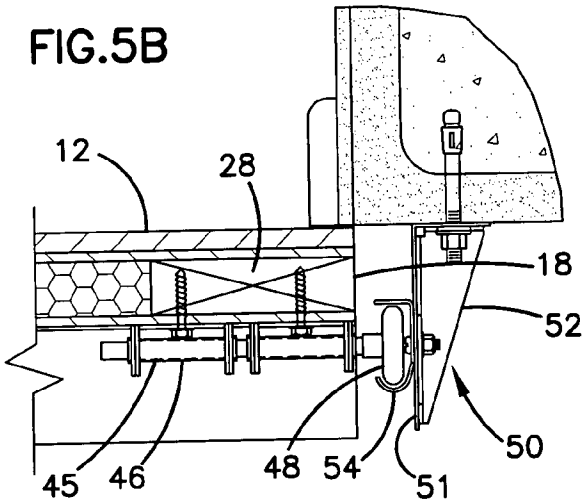

In FIG. 5B, the door is illustrated attached to a solid or filled concrete block or wall with a ⅜ inch diameter rawl power bolt with extension anchor. This bolt passes through mounting bracket 52 and tapered jamb mount 51 and should embed into the concrete a minimum of 3 inches. Front surface 12 of door 10 is generally flush with the interior surface of the concrete in which track 50 (which includes gusseted bracket 52 and elongated channel 54) is mounted. Side edge 18 of door 10 overlaps a trim piece present on the exposed outer surface of the concrete. Hinge 45, with roller passage 46, is screwed into side stile 28. Roller member 48 has its shaft extending into passage 46 and has its roller head retained within channel 54.

Figure 5C:
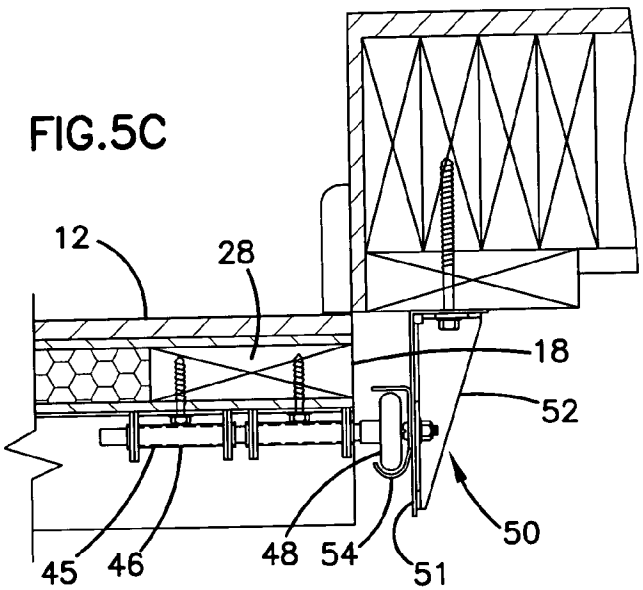

In FIG. 5C, the door is illustrated shimmed to a wooden jamb with a 5/16 inch diameter lag bolt. This lag bolt passes through mounting bracket 52 and tapered jamb mount 51 and should penetrate into the wood jamb a minimum of 2½ inches. The shim is preferably at least a No. 2 Southern Pine 2×6. Front surface 12 of door 10 is generally flush with the interior surface of the shim in which track 50 (which includes gusseted bracket 52 and elongated channel 54) is mounted, and side edge 18 of door 10 does not overlap the shim. Hinge 45, with roller passage 46, is screwed into side stile 28. Roller member 48 has its shaft extending into passage 46 and has its roller head retained within channel 54.

Figure 5D:
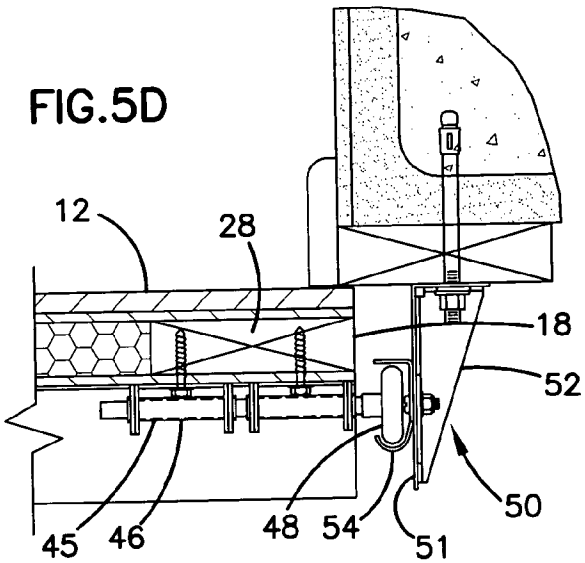

In FIG. 5D, the door is illustrated shimmed to a solid or filled concrete block or wall with a ⅜ inch diameter rawl power bolt with extension anchor. This bolt passes through mounting bracket 52 and tapered jamb mount 51 and should embed into the concrete a minimum of 3 inches. The shim is preferably at least a No. 2 Southern Pine 2×6. Front surface 12 of door 10 is generally flush with the interior surface of the shim in which track 50 (which includes gusseted bracket 52 and elongated channel 54) is mounted. Side edge 18 of door 10 overlaps a portion of the shim. Hinge 45, with roller passage 46, is screwed into side stile 28. Roller member 48 has its shaft extending into passage 46 and has its roller head retained within channel 54.

In all of FIGS. 5A through 5D, a stop member is present mounted to the jamb or the concrete. This stop member is typically flush against exterior surface 12 of door 10. Such a stop member increases the door's resistance to negative pressures, i.e., internal pressures higher than exterior pressures.

As stated above, hinges 45 and roller member 48 at side edges 16, 18 of door 10 form a force transmitting arrangement, which transfers with forces from door surfaces 12, 14 to the building structure. Additional hinges 45 are positioned across the width of door 10, as illustrated in FIG. 2B, to increase the stability of door 10. These internal hinges 45 do not include passage 46 for accepting roller member 48. Preferably, these internal hinges 45 are mounted through interior surface protection layer 34 into internal stiles 25A, 25B, 25C of frame assembly 30, preferably with at least four fasteners. In a preferred embodiment, these internal hinges 45 have the same construction as hinges 45 at side edges 16, 18, except that these hinges do not include passage 46.

Present on interior surface 14 are reinforcing struts 42 to increase resistance to flexing from side edge 16 to side edge 18. Each panel section 22A, 22B, 22C, 22D can have any number of struts 42, although two struts per section are generally preferred to provide the desired resistance. A preferred strut 42 is a 3 inch deep, 20 gauge U-shaped metal channel. Struts 42 are generally fastened, for example by wood lag screws, to panel sections 22A, 22B, 22C, 22D so that strut 42 extends away from surface 14; see, for example, FIG. 2C. In some embodiments, it may be desired to have struts 42 built into panels 22.

As stated above, the components of door 10, that is all of frame assembly 30 which includes rails 27, 29 and stiles 26, 28, 25A, 25B, 25C) and exterior and interior surface protection layers 32, 34, are wood. Typically, these components are natural wood, but in some embodiments, a wood composite may be used. The hardware, such as hinges 45, roller members 48, struts 42, as described herein, can be metal.

Returning to FIG. 2A, door 10 has windows 20 therein. In the embodiment illustrated in FIG. 2A, door 10 has two windows 20, although door 10 could have no windows, one window, three windows, four windows, etc. Windows 20 are illustrated as single panes or lites; munton bars could be included, depending on the desired look of window 20 and door 10. Typically for windows 20 in door 10, the maximum height for windows 20 is 19 inches. The typical maximum width for windows 20 when two are present is 52¾ inches.

If windows 20 are present in door 10, all portions of door 10 should withstand the hurricane force winds (typically greater than 90 mph and which can be greater than 140 mph) and meet or exceed design pressures of −65 psf and +48 psf in accordance with Miami-Dade County testing protocols PA-201, PA-202 and PA-203 and Florida state building code protocols TAS 201, 202 and 203.

Figure 8:
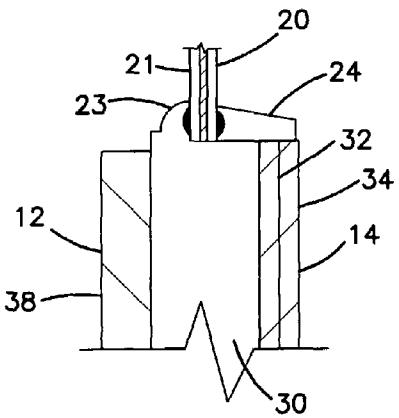
FIG. 8 is a cross-sectional side view of a glass installation in the garage door according to the present invention.

Window 20 is present in panel 22D, which is formed by frame assembly 30 having rails 27, 29 and stiles, forming a substantially rectangular border surrounding an interior section that includes window 20. Referring to FIG. 8, a cutaway portion of window 20 installed is shown. Window 20 includes a glass piece 21 approximately centered within frame assembly 30 and approximately equally positioned between exterior surface 12 and interior surface 14. A stop 23 and a glass setting lip 24 hold glass 21 in place.

Glass 21 is either a tempered glass or a laminated glass (e.g., "safety" glass). A preferred glass is a laminated glass available under the trade designation "Solutia Saflex", which has two pieces of ⅛ inch glass sandwiched around a 0.09 inch thick layer of polyvinylbutyldiene (PVB) film.

Glass 21 is retained in the door construction by glass setting lip 23 and stop 24. Glass setting lip 23 extends from and is preferably integral with the frame surrounding glass 21, specifically, top rail 27, bottom rail 29 and the stiles, although glass setting lip 23 could be fixedly attached to any of the frame, for example, by adhesive and/or nails. Preferably, glass setting lip 23 and stop 24 overlap glass 21 at least 7/16 inch. An example of a suitable stop 24 is a 7/16 inch by 1 inch glazing bead. Stop 24 can be held into place against glass 21 by mechanical and/or chemical means. One preferred adhesive is a urethane adhesive commercially available under the trade designation "Chemrex 948". In one preferred design, Chemrex 948 adhesive is used in combination with pin nails, placed approximately every 3 to 4 inches and 1 inch from the ends of stops 24.

Glass setting lip 23 includes a concave pocket, and stop 24 includes a concave pocket. The pockets allow an adhesive material to be placed between the pockets and retain glass 21 in the panel section 22D. A preferred adhesive to use is a structural silicone available from General Electric under the trade designation "GE 1200".

It was stated above that glass 21 was approximately equally positioned between exterior surface 12 and interior surface 14 in the embodiment of FIG. 8. Depending on the thickness of exterior and interior surface protection layers 32, 34, and the thickness of any decorative layer, such as trim board 38, an attempt to position glass 21 approximately equally between exterior surface 12 and interior surface 14 may not keep glass 21 at the center of frame assembly 30. To compensate, it may be desired to move both surface protection layers 32, 34 to one side; in FIG. 8, both layers 32, 34 are present on the interior side of frame assembly 30. This is acceptable to maintain the impact resistance rating, as overall, the thickness and material of the panel have not changed.

Door 10 can be made by standard carpentry techniques incorporating the designs described herein. Following is described one method for manufacturing door 10. First, frame 30 is assembled from rails 27, 29 and stiles 26, 28 and 25A, 25B, 25C. Preferably, the rails and stiles have a cope and stick fitting and are attached together using adhesive and a pocket hole attachment system. One will note that rails 27, 29 run the length of the eventual panel. Exterior and interior surface protection layers 32, 24 are fastened to frame 30, forming a boxed structure, using adhesive and screws. Any decorative layer, such as layers 36, 38, is mounted over exterior surface protection layer 34 with staples, nails, screws, and/or adhesive. The resulting panel is then hingedly attached to similar panels.

A windowed panel can be made by similar techniques. Frame 30 is made to include glass setting lip 23 on the inner edges of the rails and stiles that surround window glass 21. Two surface protection layers 32, 34 are fastened to frame 30 on the interior side of the panel, and any decorative layers, such as 36 and/or 38, are mounted on the exterior side of the panel. To install the window, a bead of adhesive is applied into a pocket of glass setting lip 23, and glass 21 is placed therein. Stop 24, having adhesive present in its pocket, is attached against glass 21 with adhesive and nails.

Door 10, as described above, is designed for installation in regions prone to hurricanes and tropical storms. Such regions, being generally warm and close to large bodies of water, have relatively high humidity throughout the year. Due to these conditions, the risk and rate of decaying or rotting wood in these areas is high. To increase the door's resistance to decay, a wood preservative is preferably present in door 10, preferably in each of the components. As one construction example, the components such as rails 27, 29, stiles 26, 28, 25A, 25B, 25C, and interior and exterior surface protection layers 32, 34 can be made from pressure treated or Wolmanized lumber. If not present in the lumber components prior to assembling door 10, the components or door 10 can be treated after assembly of door 10. Red cedar is inherently fairly resistant to decay, and is thus a preferred material, for decorative layer 36 and decorative trim 38 as a chemical treatment is generally not needed.

Additionally or alternately to having treated wood, a solid wood preservative may be included in door 10. One example of a solid wood preservative is borate rods such as available under the trade designation "Impel". These rods are designed to be inserted into holes drilled into the wood to be protected.

The above description has provided a custom designed, wood, sectional garage door and garage door assembly that incorporates aesthetic features while meeting strict standards and without hampering functionality. The "platform" design provides door 10 with a construction that withstands structural loads while offers a high degree of flexibility in the facade of the door. The design also allows for windows or "lites" in door 10 to provide architectural design elements and natural light in the interior space. Door 10 also resists rot, decay and invasion by wood boring insects, which is beneficial in areas such as Florida that have high humidity climates that are conducive to these conditions. Door 10 withstands very high wind loads such as those created by hurricane force winds typically greater than 90 mph and which can be greater than 140 mph. Additionally, door 10 and its assembly meet or exceed design pressures of −65 psf and +48 psf, in accordance with Miami-Dade County testing protocols PA-201, PA-202 and PA-203 and Florida state building code protocols TAS 201, 202 and 203.

The various embodiments described above are provided by way of illustration only and should not be construed to limit the invention. Those skilled in the art will readily recognize various modifications and changes that may be made to the present invention without following the example embodiments and applications illustrated and described herein, and without departing from the true spirit and scope of the present invention, which is set forth in the following claims.

What is claimed:

1. A wood garage door comprising:

(a) a wooden internal frame having a first side and an opposite second side; the frame comprising:

(i) a top rail and a bottom rail;

(ii) a first side stile, a second side stile, and a first internal stile and at least a second internal stile positioned between the first side stile and the second side stile, each of the stiles extending between the top rail and the bottom rail, with the first internal stile and the at least second stile having a centerline distance therebetween of no greater than 28⅝ inches;

(b) a first wood surface protection layer attached to and covering the first side of the internal frame; and (c) a second wood surface protection layer attached to and covering the second side of the internal frame;

the garage door constructed and arranged to withstand a 140 mph wind load against the first surface.

2. The garage door according to claim 1, further comprising a decorative layer attached to the second wood surface protection layer opposite the internal frame.

3. The garage door according to claim 2, wherein:

(a) the first wood surface protection layer comprises plywood;

(b) the second wood surface protection layer comprises plywood; and (c) the decorative layer comprises boards.

4. The garage door according to claim 3, wherein:

(a) the first wood surface protection layer comprises ¼ inch plywood;

(b) the second wood surface protection layer comprises ¼ inch plywood; and (c) the decorative layer comprises tongue and groove boards.

5. The garage door according to claim 1, comprising at least three panels hingedly connected together, each panel comprising:

(a) a wooden internal frame having a first side and an opposite second side; the frame comprising:

(i) a top rail and a bottom rail;

(ii) a first side stile, a second side stile, and a first internal stile and at least a second internal stile positioned between the first side stile and the second side stile, each of the stiles extending between the top rail and the bottom rail, with the first internal stile and the at least second stile having a centerline distance therebetween of no greater than 28⅝ inches;

(b) a first wood surface protection layer attached to and covering the first side of the internal frame; and (c) a second wood surface protection layer attached to and covering the second side of the internal frame.

6. The garage door according to claim 5, further comprising a panel having at least one window therein.

7. A wood garage door comprising:

(a) a wooden internal frame having a first side and an opposite second side; the frame comprising:

(i) a top rail and a bottom rail;

(ii) a first side stile, a second side stile, and a first internal stile and at least a second internal stile positioned between the first side stile and the second side stile, each of the stiles extending between the top rail and the bottom rail, with the first internal stile and the at least second stile having a centerline distance therebetween of no greater than 28⅝ inches;

(b) a first wood surface protection layer attached to and covering the first side of the internal frame; and (c) a second wood surface protection layer attached to and covering the second side of the internal frame;

the garage door constructed and arranged to withstand pressure of +48 psf and −65 psf.

8. The garage door according to claim 7, further comprising a decorative layer attached to the second wood surface protection layer opposite the internal frame.

9. The garage door according to claim 8, wherein:

(a) the first wood surface protection layer comprises plywood;

(b) the second wood surface protection layer comprises plywood; and (c) the decorative layer comprises boards.

10. The garage door according to claim 9, wherein:

(a) the first wood surface protection layer comprises ¼ inch plywood;

(b) the second wood surface protection layer comprises ¼ inch plywood; and (c) the decorative layer comprises tongue and groove boards.

11. The garage door according to claim 7, comprising at least three panels hingedly connected together, each panel comprising:

(a) a wooden internal frame having a first side and an opposite second side; the frame comprising:

(i) a top rail and a bottom rail;

(ii) a first side stile, a second side stile, and a first internal stile and at least a second internal stile positioned between the first side stile and the second side stile, each of the stiles extending between the top rail and the bottom rail, with the first internal stile and the at least second stile having a centerline distance therebetween of no greater than 28⅝ inches;

(b) a first wood surface protection layer attached to and covering the first side of the internal frame; and (c) a second wood surface protection layer attached to and covering the second side of the internal frame.

12. The garage door according to claim 11, further comprising a panel having at least one window therein.

13. A wood garage door assembly comprising:

(a) a wooden garage door comprising:

(i) a wooden internal frame having a first side and an opposite second side;

the frame comprising:

(A) a top rail and a bottom rail;

(B) a first side stile, a second side stile, and a first internal stile and at least a second internal stile positioned between the first side stile and the second side stile, each of the stiles extending between the top rail and the bottom rail, with the first internal stile and the at least second stile having a centerline distance therebetween of no greater than 28⅝ inches;

(ii) a first wood surface protection layer attached to and covering the first side of the internal frame; and (ii) a second wood surface protection layer attached to and covering the section side of the internal frame;

(b) force transmitting arrangement connected to the wooden garage door, the arrangement comprising:

(i) a plurality of roller members, a pair of roller member attached at each of the frame first side and the frame second side; and (ii) a track for receiving at least a portion of the roller members;

the garage door assembly constructed and arranged to withstand a 140 mph wind load against the first surface.

14. The garage door assembly according to claim 13, wherein the track comprises:

(a) a jamb mount;

(b) a plurality of mounting brackets; and (c) an elongate channel for receiving at least a portion of the roller members.

15. The garage door assembly according to claim 14, wherein the mounting brackets are gusseted mounting brackets.

16. The garage door assembly according to claim 13, wherein the garage door further comprises a decorative layer attached to the second wood surface protection layer opposite the internal frame.

17. A wood garage door assembly comprising:

(a) a wooden garage door comprising:

(i) a wooden internal frame having a first side and an opposite second side;

the frame comprising:

(A) a top rail and a bottom rail;

(B) a first side stile, a second side stile, and a first internal stile and at least a second internal stile positioned between the first side stile and the second side stile, each of the stiles extending between the top rail and the bottom rail, with the first internal stile and the at least second stile having a centerline distance therebetween of no greater than 28⅝ inches;

(ii) a first wood surface protection layer attached to and covering the first side of the internal frame; and (ii) a second wood surface protection layer attached to and covering the section side of the internal frame;

(b) force transmitting arrangement connected to the wooden garage door, the arrangement comprising:

(i) a plurality of roller members, a pair of roller member attached at each of the frame first side and the frame second side; and ii) a track for receiving at least a portion of the roller members; the garage door assembly constructed and arranged to withstand pressure of +48 psf and −65 psf.

18. The garage door assembly according to claim 17, wherein the track comprises:

(a) a jamb mount;

(b) a plurality of mounting brackets; and (c) an elongate channel for receiving at least a portion of the roller members.

19. The garage door assembly according to claim 18, wherein the mounting brackets are gusseted mounting brackets.

20. The garage door assembly according to claim 17, wherein the garage door further comprises a decorative layer attached to the second wood surface protection layer opposite the internal frame.

21. A wood garage door comprising:

(a) at least two panel sections, each panel section having a top edge, a bottom edge, and first and second side edges, each panel section comprising:

(i) an internal frame having a first side and an opposite second side the frame comprising:

(A) a top rail and a bottom rail;

(B) a first side stile, a second side stile, and a first internal stile and at least a second internal stile positioned between the first side stile and the second side stile, each of the stiles extending between the top rail and the bottom rail, with the first internal stile and the at least second stile having a centerline distance therebetween of no greater than 28⅝ inches;

(ii) a first wood surface protection layer attached to and covering the first side of the internal frame;

(iii) a second wood surface protection layer attached to and covering the second side of the internal frame;

(iv) a decorative layer attached to the second wood surface protection layer opposite the internal frame;

(b) the at least two panel sections hingedly connected together by at least five hinges, two of the hinges positioned at the first side edge and having a roller passage, two of the hinges positioned at the second side edge and having a roller passage, and a fifth hinge positioned between the first side edge and the second side edge; and (c) at least two rollers, a first roller positioned at the first side edge and having a shaft positioned within the hinge roller passage, and a second roller positioned at the second side edge and having a shaft positioned within the hinge roller passage.

* * * * *